US009527303B2

(12) United States Patent
Ishida et al.

(10) Patent No.: US 9,527,303 B2
(45) Date of Patent: Dec. 27, 2016

(54) IMAGE FORMING APPARATUS AND IMAGE FORMING METHOD TO FORM AN IMAGE BY SCANNING AN IMAGE BEARER WITH LIGHT MODULATED BASED ON IMAGE INFORMATION

(71) Applicants: Masaaki Ishida, Kanagawa (JP); Atsufumi Omori, Kanagawa (JP); Muneaki Iwata, Kanagawa (JP); Hayato Fujita, Kanagawa (JP)

(72) Inventors: Masaaki Ishida, Kanagawa (JP); Atsufumi Omori, Kanagawa (JP); Muneaki Iwata, Kanagawa (JP); Hayato Fujita, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 13 days.

(21) Appl. No.: 14/585,383

(22) Filed: Dec. 30, 2014

(65) Prior Publication Data

US 2015/0251442 A1 Sep. 10, 2015

(30) Foreign Application Priority Data

Jan. 10, 2014 (JP) ..... 2014-002805
May 21, 2014 (JP) ..... 2014-104847

(51) Int. Cl.
*B41J 2/47* (2006.01)

(52) U.S. Cl.
CPC *B41J 2/471* (2013.01); *B41J 2/47* (2013.01); *B41J 2/473* (2013.01)

(58) Field of Classification Search
CPC ..... B41J 2/471; B41J 2/47; B41J 2/273
USPC ..... 347/142–144, 237, 240, 247, 251–254; 358/296, 298, 530, 532
See application file for complete search history.

(56) References Cited

U.S. PATENT DOCUMENTS 5,546,111 A * 8/1996 Maeda ..... G06K 15/1223 347/144
6,118,798 A * 9/2000 Ema ..... H01S 5/042 372/25
6,498,617 B1 12/2002 Ishida et al.
(Continued)

FOREIGN PATENT DOCUMENTS

JP 2005-193540 7/2005

OTHER PUBLICATIONS

U.S. Appl. No. 14/556,745, filed Dec. 1, 2014.

*Primary Examiner* — Henok Legesse
(74) *Attorney, Agent, or Firm* — Oblon, McClelland, Maier & Neustadt, L.L.P.

(57) ABSTRACT

An image forming apparatus includes a drive signal generating unit that generates a drive signal for driving a light source based on a reference pulse signal serving as a reference to form a plurality of pixels arranged in the main-scanning direction of an image, and the drive signal generating unit generates the drive signal by adjusting the pulse width of the reference pulse signal so that the amplitude of portions of the reference pulse signal with the adjusted pulse width corresponding to specific pixels among the pixels is larger than the amplitude of portions corresponding to normal pixels that are pixels other than the specific pixels among the pixels, and so that the pulse width of the portions of the reference pulse signal with the adjusted pulse width corresponding to the specific pixels is smaller than the pulse width of the portions corresponding to the normal pixels.

16 Claims, 18 Drawing Sheets

(56) References Cited

U.S. PATENT DOCUMENTS

| | | | | |
|---|---|---|---|---|
| 8,334,887 | B2 * | 12/2012 | Gentner | B41J 2/473 347/224 |
| 2002/0130944 | A1 | 9/2002 | Ema et al. | |
| 2003/0025785 | A1 | 2/2003 | Nihei et al. | |
| 2003/0067533 | A1 | 4/2003 | Omori et al. | |
| 2007/0132828 | A1 | 6/2007 | Ishida et al. | |
| 2008/0088893 | A1 | 4/2008 | Ishida et al. | |
| 2008/0123160 | A1 | 5/2008 | Omori et al. | |
| 2008/0218813 | A1 | 9/2008 | Tanabe et al. | |
| 2008/0225106 | A1 | 9/2008 | Omori et al. | |
| 2008/0239336 | A1 | 10/2008 | Tanabe et al. | |
| 2008/0291259 | A1 | 11/2008 | Nihei et al. | |
| 2009/0091805 | A1 | 4/2009 | Tanabe et al. | |
| 2009/0174915 | A1 | 7/2009 | Nihei et al. | |
| 2009/0195635 | A1 | 8/2009 | Ishida et al. | |
| 2011/0199657 | A1 | 8/2011 | Ishida et al. | |
| 2011/0228037 | A1 * | 9/2011 | Omori | G03G 15/043 347/247 |
| 2012/0099165 | A1 | 4/2012 | Omori et al. | |
| 2012/0189328 | A1 | 7/2012 | Suzuki et al. | |
| 2012/0293783 | A1 | 11/2012 | Ishida et al. | |
| 2013/0243459 | A1 | 9/2013 | Omori et al. | |
| 2013/0302052 | A1 | 11/2013 | Iwata et al. | |
| 2014/0139603 | A1 | 5/2014 | Fujita et al. | |
| 2014/0139605 | A1 | 5/2014 | Fujita et al. | |
| 2014/0176656 | A1 | 6/2014 | Omori et al. | |
| 2014/0268186 | A1 | 9/2014 | Iwata et al. | |
| 2014/0327938 | A1 | 11/2014 | Ishida et al. | |
| 2014/0333940 | A1 | 11/2014 | Iwata et al. | |
| 2014/0333941 | A1 | 11/2014 | Iwata et al. | |
| 2015/0156373 | A1 * | 6/2015 | Fujita | H04N 1/40056 358/475 |

* cited by examiner

IMAGE FORMING APPARATUS AND IMAGE FORMING METHOD TO FORM AN IMAGE BY SCANNING AN IMAGE BEARER WITH LIGHT MODULATED BASED ON IMAGE INFORMATION

CROSS-REFERENCE TO RELATED APPLICATIONS

The present application claims priority to and incorporates by reference the entire contents of Japanese Patent Application No. 2014-002805 filed in Japan on Jan. 10, 2014 and Japanese Patent Application No. 2014-104847 filed in Japan on May 21, 2014.

BACKGROUND OF THE INVENTION

1. Field of the Invention

The present invention relates to an image forming apparatus and an image forming method, and more in detail, to an image forming apparatus and an image forming method that form an image by scanning an image bearer with light modulated based on image information.

2. Description of the Related Art

Image forming apparatuses have so far been known that form an image by scanning an image bearer with light modulated based on image information (refer, for example, to Japanese Laid-open Patent Publication No. 2005-193540).

An image forming apparatus disclosed in Japanese Laid-open Patent Publication No. 2005-193540, however, has low image reproducibility.

SUMMARY OF THE INVENTION

It is an object of the present invention to at least partially solve the problems in the conventional technology.

According to the present invention, there is provided an image forming apparatus that forms an image by scanning an image bearer with light modulated based on image information, the image forming apparatus comprising: a light source that emits the light; and a drive signal generating unit that generates a drive signal for driving the light source based on a reference pulse signal serving as a reference to form a plurality of pixels arranged in a main-scanning direction of the image, wherein the drive signal generating unit generates the drive signal by adjusting a pulse width of the reference pulse signal so that an amplitude of a portion or portions of the reference pulse signal with the adjusted pulse width corresponding to a specific pixel or pixels among the pixels is larger than an amplitude of a portion or portions of the reference pulse signal with the adjusted pulse width corresponding to a normal pixel or pixels that is/are a pixel or pixels other than the specific pixel or pixels among the pixels, and so that the pulse width of the portion or portions of the reference pulse signal with the adjusted pulse width corresponding to the specific pixel or pixels is smaller than a pulse width of the portion or portions of the reference pulse signal with the adjusted pulse width corresponding to the normal pixel or pixels.

The present invention also provides an image forming apparatus that forms an image with light modulated according to image data, the image forming apparatus comprising: a light source; a pulse generating unit that generates a reference pulse signal serving as a reference to control the light source based on the image data; a pulse width adjusting unit that adjusts a pulse width of the reference pulse signal; and a supply current generating unit that generates a supply current to be supplied to the light source based on the reference pulse signal with the pulse width thereof adjusted by the pulse width adjusting unit.

The present invention also provides an image forming method for forming an image by scanning an image bearer with light modulated based on image information, the image forming method comprising a step of generating, based on a reference pulse signal serving as a reference to form a plurality of pixels arranged in a main-scanning direction of the image, a drive signal for driving a light source that emits the light, wherein the step of generating comprises: a sub-step of adjusting a pulse width of the reference pulse signal; and another sub-step of setting an amplitude of a portion or portions of the reference pulse signal with the adjusted pulse width corresponding to a specific pixel or pixels among the pixels larger than an amplitude of a portion or portions of the reference pulse signal with the adjusted pulse width corresponding to a normal pixel or pixels that is/are a pixel or pixels other than the specific pixel or pixels among the pixels, and setting the pulse width of the portion or portions of the reference pulse signal with the adjusted pulse width corresponding to the specific pixel or pixels smaller than a pulse width of the portion or portions of the reference pulse signal with the adjusted pulse width corresponding to the normal pixel or pixels.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENT

Figure 1:
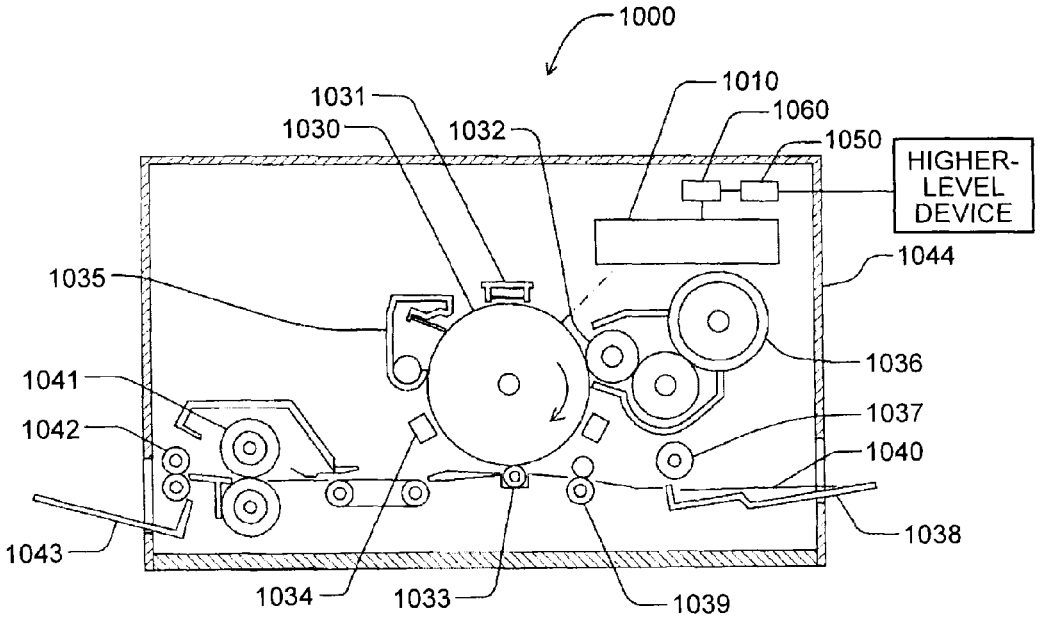
FIG. 1 is a diagram illustrating a schematic configuration of a laser printer according to an embodiment of the present invention.
Figure 2:
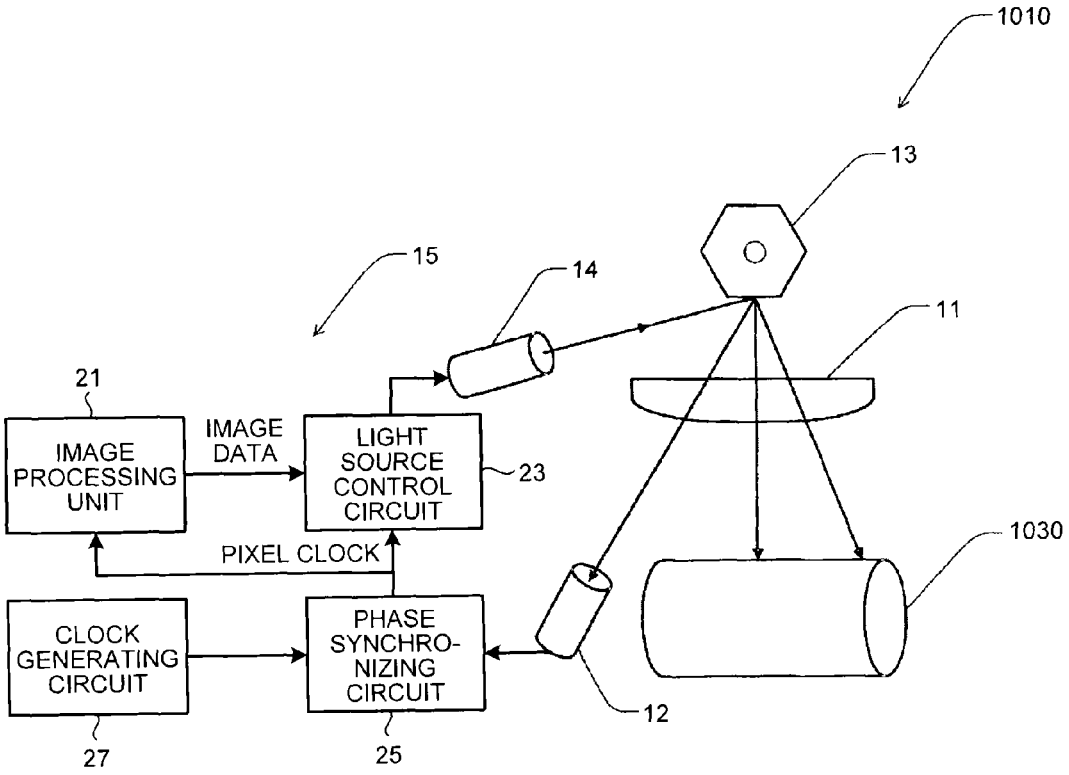
FIG. 2 is a diagram for explaining an optical scanning device in FIG. 1.

The following describes an embodiment of the present invention based on FIGS. 1 to 13. FIG. 1 illustrates a schematic configuration of a laser printer 1000 according to the embodiment.

The laser printer 1000 includes, for example, an optical scanning device 1010; a photoconductor drum 1030; an electric charger 1031; a development roller 1032; a transfer charger 1033; a neutralization unit 1034; a cleaning unit 1035; a toner cartridge 1036; a sheet feeding roller 1037; a sheet feeding tray 1038; a pair of registration rollers 1039; fixing rollers 1041; discharging rollers 1042; a discharge tray 1043; a communication control device 1050; and a printer control device 1060 that integrally controls the above-mentioned units. These units and devices are housed in predetermined positions in a printer housing 1044.

The communication control device 1050 controls bidirectional communication with a higher-level device (such as a personal computer) via a network or the like.

The photoconductor drum 1030 is a cylindrical member with a photosensitive layer formed on the surface thereof. Specifically, the surface of the photoconductor drum 1030 is a scanned surface. The photoconductor drum 1030 rotates in the direction indicated by the arrow in FIG. 1.

The electric charger 1031, the development roller 1032, the transfer charger 1033, the neutralization unit 1034, and the cleaning unit 1035 are arranged near the surface of the photoconductor drum 1030. They are arranged along the direction of rotation of the photoconductor drum 1030 in the order of the electric charger 1031, the development roller 1032, the transfer charger 1033, the neutralization unit 1034, and the cleaning unit 1035.

The electric charger 1031 uniformly charges the surface of the photoconductor drum 1030.

The optical scanning device 1010 scans the surface of the photoconductor drum 1030 charged by the electric charger 1031 with a laser beam modulated based on image information (image data) from the higher-level device, and thus forms an electrostatic latent image corresponding to the image information on the surface of the photoconductor drum 1030. The electrostatic latent image formed in this process moves toward the development roller 1032 as the photoconductor drum 1030 rotates. The configuration of the optical scanning device 1010 will be described later.

The toner cartridge 1036 contains toner, which is supplied to the development roller 1032.

The development roller 1032 deposits the toner supplied from the toner cartridge 1036 on the electrostatic latent image formed on the surface of the photoconductor drum 1030, and thus visualizes the image information. The electrostatic latent image on which the toner has been deposited in this process (hereinafter, also called a "toner image" for convenience) moves toward the transfer charger 1033 as the photoconductor drum 1030 rotates.

The sheet feeding tray 1038 stores therein recording sheets 1040. The sheet feeding roller 1037 is disposed near the sheet feeding tray 1038. The sheet feeding roller 1037 takes the recording sheets 1040 one by one out of the sheet feeding tray 1038, and conveys them to the pair of registration rollers 1039. The pair of registration rollers 1039 once holds each of the recording sheets 1040 taken out by the sheet feeding roller 1037, and feeds out the recording sheet 1040 toward a nip between the photoconductor drum 1030 and the transfer charger 1033 in synchronization with the rotation of the photoconductor drum 1030.

To electrically attract the toner from the surface of the photoconductor drum 1030 to the recording sheet 1040, a voltage having the opposite polarity to that of the toner is applied to the transfer charger 1033. This voltage transfers the toner image onto the surface of the photoconductor drum 1030 to the recording sheet 1040. The recording sheet 1040 to which the toner image has been transferred in this process is fed to the fixing rollers 1041.

At the fixing rollers 1041, heat and pressure are applied to the recording sheet 1040 so as to fix the toner onto the recording sheet 1040. The recording sheet 1040 having undergone this fixing process is fed to the discharge tray 1043 via the discharging rollers 1042, and is sequentially stacked on the discharge tray 1043.

The neutralization unit 1034 electrically neutralizes the surface of the photoconductor drum 1030.

The cleaning unit 1035 removes the toner (residual toner) remaining on the surface of the photoconductor drum 1030. The surface of the photoconductor drum 1030 from which the remaining toner has been removed returns to a position facing the electric charger 1031.

The configuration of the optical scanning device 1010 will be described. As illustrated as an example in FIG. 2, the optical scanning device 1010 includes, for example, a laser diode (LD) 14 serving as a light source, a polygon mirror 13, a scanning lens 11, a photodetector (PD) 12 serving as a light-receiving element, and a scanning control device 15. These devices are mounted in predetermined positions in a housing (not illustrated).

Hereinafter, for convenience, the direction corresponding to the main-scanning direction will be called, for short, the "main-scanning corresponding direction", and the direction corresponding to the sub-scanning direction will be called, for short, the "sub-scanning corresponding direction".

The LD 14 is also called an edge-emitting laser diode, and emits a laser beam toward a deflecting reflection surface of the polygon mirror 13.

For the purpose of simplified description, the present embodiment is described to use the single laser diode (LD) as the light source. However, the light source may actually be a laser diode array (LDA) including a plurality of one-dimensionally or two-dimensionally arranged LDs, a single vertical cavity surface emitting laser (VCSEL) diode, or a surface-emitting laser array (VCSELA) including a plurality of one-dimensionally or two-dimensionally arranged surface-emitting laser (VCSEL) diodes.

The polygon mirror 13 has, for example, six plane mirrors with an in circle radius of 18 mm, where each of the mirrors serves as the deflecting reflection surface. The polygon mirror 13 deflects the laser beam from the LD 14 while rotating at a constant velocity about an axis parallel to the sub-scanning corresponding direction.

An optical system that forms an image with the laser beam emitted from the LD 14 near the deflecting reflection surface of the polygon mirror 13 with respect to the sub-scanning corresponding direction (also called a pre-deflector optical system) may be provided between the LD 14 and the polygon mirror 13. Examples of optical elements constituting the pre-deflector optical system include, but are not limited to, a coupling lens, an aperture member, a cylindrical lens, and a reflecting mirror.

The scanning lens 11 is arranged in the optical path of the laser beam deflected by the polygon mirror 13. The laser beam having passed through scanning lens 11 is projected (focused) on the surface of the photoconductor drum 1030, thus forming a light spot thereon. The light spot moves in the longitudinal direction of the photoconductor drum 1030 as the polygon mirror 13 rotates. In other words, the light spot scans the surface of the photoconductor drum 1030. The direction of movement of the light spot in this operation corresponds to the main-scanning direction. The direction of rotation of the photoconductor drum 1030 corresponds to the sub-scanning direction.

The optical system arranged in the optical path between the polygon mirror 13 and the photoconductor drum 1030 is also called a scanning optical system. In the present embodiment, the scanning optical system is constituted by the scanning lens 11. The scanning optical system may have a plurality of scanning lenses. At least one turning back mirror may be arranged on at least one side of the optical path between the scanning lens 11 and the photoconductor drum 1030.

The PD 12 is arranged in an optical path of the laser beam that has been deflected by the polygon mirror 13 and has passed through the scanning lens 11, and sends a light-receiving result to the scanning control device 15. The PD 12 may be arranged downstream in the scanning direction of the photoconductor drum 1030, or may be arranged upstream in the scanning direction thereof.

Thus, the laser beam from the LD 14 is deflected by the rotating polygon mirror 13, and projected on the photoconductor drum 1030 serving as a scanned medium via the scanning lens 11. The projected laser beam forms the light spot on the photoconductor drum 1030, and thus forms the electrostatic latent image on the photoconductor drum 1030.

The laser beam deflected by the polygon mirror 13 enters the PD 12 after a scan of one line is finished or before a scan of one line is started. After receiving the laser beam, the PD 12 converts the amount of the received beam into an electrical signal, and outputs the electrical signal to a phase synchronizing circuit 25 (to be described later).

The scanning control device 15 includes, for example, an image processing unit 21, a light source control circuit 23, the phase synchronizing circuit 25, and a clock generating circuit 27.

After receiving the electrical signal, the phase synchronizing circuit 25 generates a pixel clock for the next one line. A high-frequency clock signal is supplied from the clock generating circuit 27 to the phase synchronizing circuit 25, whereby phase synchronization of the pixel clock is performed. The pixel clock generated by the phase synchronizing circuit 25 is supplied to the image processing unit 21 and the light source control circuit 23.

The image processing unit 21 applies predetermined processing to the image data (image information) from the higher-level device, and supplies the processed image data to the light source control circuit 23 according to the pixel clock supplied from the phase synchronizing circuit 25.

The light source control circuit 23 drives the LD 14 based on the pixel clock from the phase synchronizing circuit 25 and the image data from the image processing unit 21. As a result, the electrostatic latent image according to the image information is formed on the photoconductor drum 1030.

Figure 3:
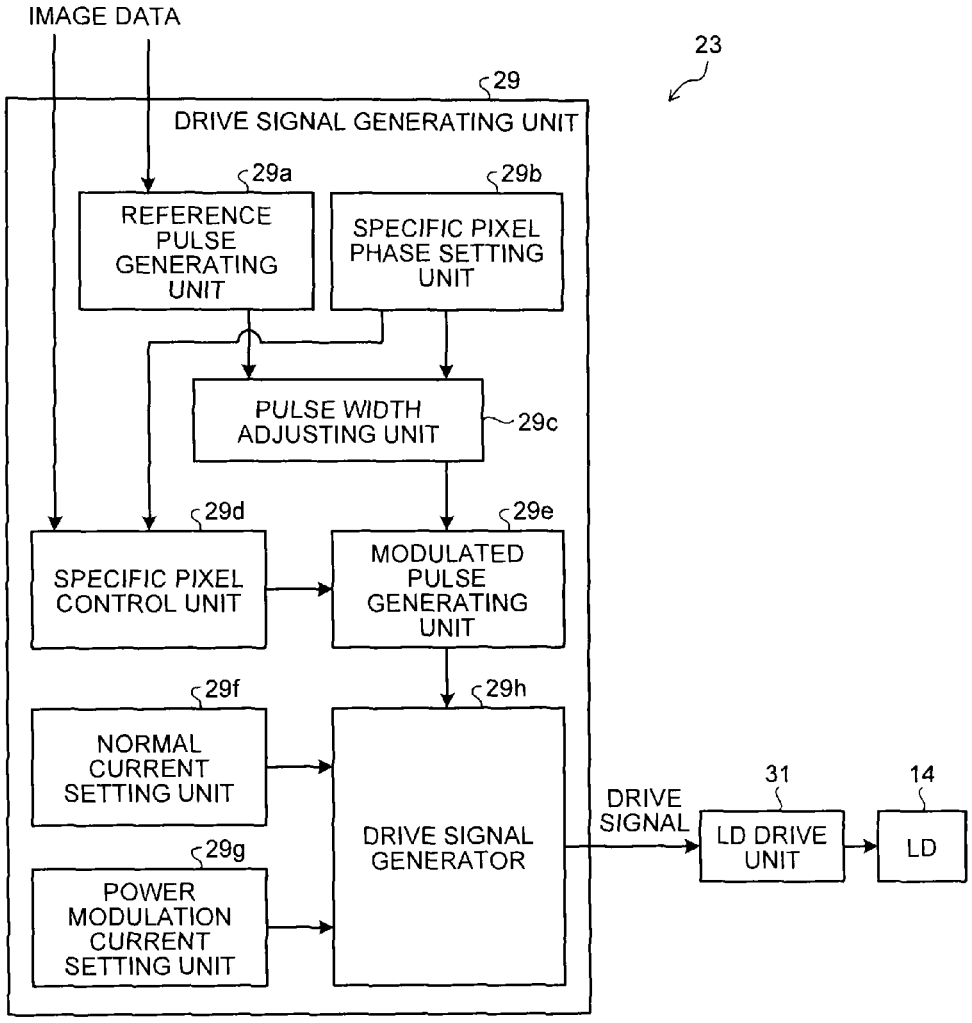
FIG. 3 is a diagram (No. 1) for explaining the configuration of a light source control circuit.

The following describes the light source control circuit 23 in detail. As illustrated in FIG. 3, the light source control circuit 23 includes a drive signal generating unit 29 and an LD drive unit 31.

The drive signal generating unit 29 includes, for example, a reference pulse generating unit 29*a*, a specific pixel phase setting unit 29*b*, a pulse width adjusting unit 29*c*, a specific pixel control unit 29*d*, a modulated pulse generating unit 29*e*, a normal current setting unit 29*f*, a power modulation current setting unit 29*g*, and a drive signal generator 29*h*.

The reference pulse generating unit 29*a* generates, for example, a reference pulse signal that serves as a reference for forming a row of pixels including a plurality of pixels arranged in the main-scanning direction of an image corresponding to the image data from the higher-level device (for example, at least one rectangular pulse signal corresponding to the pixels) for each of a plurality of such rows of pixels arranged in the sub-scanning direction. The reference pulse generating unit 29*a* sends the generated reference pulse signal corresponding to each of the rows of pixels to the pulse width adjusting unit 29*c*.

As will be described later, the specific pixel phase setting unit 29*b* sets in advance the phase of a portion of the reference pulse signal that is adjusted in pulse width by the pulse width adjusting unit 29*c*, where the portion of the reference pulse signal corresponds to specific pixels when the pulse width is reduced by the specific pixel control unit 29*d* to a value smaller than that of a portion corresponding to normal pixels; that is, the specific pixel phase setting unit 29*b* sets in advance the position of a portion corresponding to the specific pixels relative the original center position (center position before the pulse width is reduced) of the center position with respect to the main-scanning direction. The specific pixel phase setting unit 29*b* sends the phase (position) thus set to the pulse width adjusting unit 29*c*. In this specification, for convenience, the phase is called a central phase when the center position of the portion corresponding to the specific pixels with the reduced pulse width is coincident with or not much deviating from the original center position with respect to the main-scanning direction; the phase is called a right phase when the center position lies on the right side of that of the central phase in a drawing; and the phase is called a left phase when the center position lies on the left side of that of the central phase in a diagram. The "normal pixels" refer to pixels other than the specific pixels among a plurality of pixels constituting the image data.

The pulse width adjusting unit 29*c* adjusts the pulse width of the reference pulse signal based on the reference pulse signal received from the reference pulse generating unit 29*a* and the phase received from the specific pixel phase setting unit 29*b*, and sends the reference pulse signal with the adjusted pulse width (hereinafter, also called a pulse-width-adjusted pulse signal) to the modulated pulse generating unit 29*e*. The adjustment of the pulse width by the pulse width adjusting unit 29*c* will be described later in detail.

The specific pixel control unit 29*d* detects specific pixels of the image corresponding to the image data from the higher-level device (such as pixels included in an edge in the main-scanning direction of the image), and, based on the phase set by the specific pixel phase setting unit 29*b*, generates a control signal to control the lighting timing and the lighting duration (the pulse width of the portion corresponding to the specific pixels) of the LD 14 when the specific pixels are formed. The generated control signal is sent to the modulated pulse generating unit 29*e*. In this process, the lighting duration of the LD 14 is set shorter when the specific pixels are formed than when the normal pixels are formed.

Based on the reference pulse signal with the adjusted pulse width sent from the pulse width adjusting unit 29*c* and the control signal sent from the specific pixel control unit 29*d*, the modulated pulse generating unit 29*e* generates a modulated pulse signal for controlling on/off of the LD 14, and sends the modulated pulse signal to the drive signal generator 29*h*. In this process, the modulated pulse signal is generated so that the pulse width of the portion corresponding to the specific pixels is smaller than the pulse width of the portion corresponding to the normal pixels.

The normal current setting unit 29*f* sets the current value required for the LD 14 to emit light to form the normal pixels, and sends the set value to the drive signal generator 29*h*.

The power modulation current setting unit 29*g* sets the current value to be supplied to the LD 14 to form the specific pixels to a value larger than the current value required for the LD 14 to emit light to form the normal pixels, that is, to a value N times (N>1) larger than the set value by the normal current setting unit 29*f*, and sends the larger set value to the drive signal generator 29*h*.

Based on the modulated pulse signal sent from the modulated pulse generating unit 29*e*, the set value sent from the normal current setting unit 29*f*, and the set value sent from the power modulation current setting unit 29*g*, the drive signal generator 29*h* generates a drive signal for driving the LD 14, and outputs the drive signal to the LD drive unit 31. In this process, the drive signal is generated so as to have a larger amplitude at a portion corresponding to the specific pixels than that at a portion corresponding to the normal pixels, and so as to have a smaller pulse width at the portion corresponding to the specific pixels than that at the portion corresponding to the normal pixels.

Figure 4:
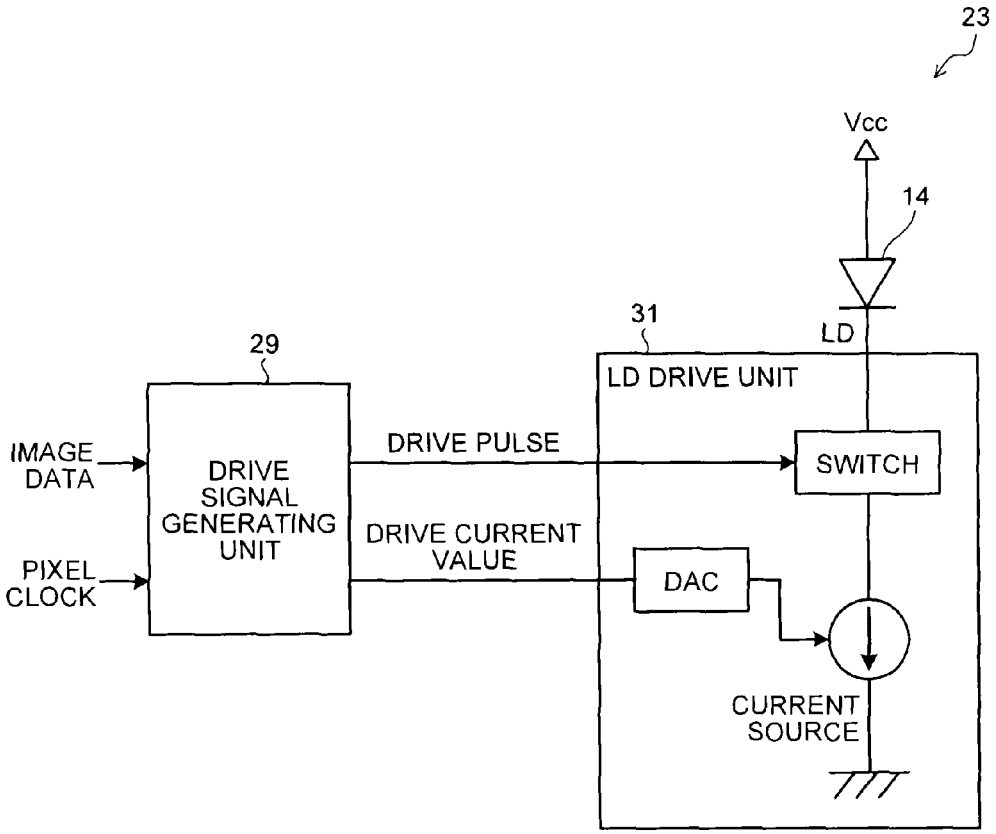
FIG. 4 is a diagram (No. 2) for explaining the configuration of the light source control circuit.

As illustrated in FIG. 4, the LD drive unit 31 drives the LD 14 based on the drive signal from the drive signal generating unit 29.

A current source to the LD 14 is configured to feed a current in the forward direction of the LD 14 based on the drive signal (refer to FIG. 4).

In this configuration, the drive current value (amplitude value of the drive signal) can be digitally set using digital-to-analog converter (DAC) codes. A switch (such as a transistor) is turned on/off based on drive pulses (pulses of the drive signal) so as to turn on/off the current supply from the current source to the LD 14, thereby allowing the emission of light to be controlled to achieve a desired lighting pattern (refer to FIG. 4).

The following describes a method for generating the modulated pulse signal with the drive signal generating unit 29. As described above, the modulated pulse signal is a signal for controlling on/off (turn-on/turn-off) of the LD 14. Specifically, the LD 14 is lit up when the modulated pulse signal is at a high level (H), and turned off when the modulated pulse signal is at a low level (L).

First, the specific pixel control unit 29*d* applies pattern matching to the image data from the higher-level device to detect the specific pixels (such as pixels included in an edge in the main-scanning direction). In this process, if object information indicating the attribute of the image is available, the specific pixel control unit 29*d* applies the pattern matching to an image area required to be pattern-matched based on the attribute of the image, and performs the detection. The "attribute of the image" refers to, for example, a character, a photograph, or a graphic.

The specific pixel control unit 29*d* then controls (sets) the lighting timing and the lighting duration of the LD 14 when the specific pixels are formed. Specifically, the specific pixel control unit 29*d* controls the phase (position) and the pulse width of the portion of the reference pulse signal with the adjusted pulse width corresponding to the specific pixels.

Figure 5A:
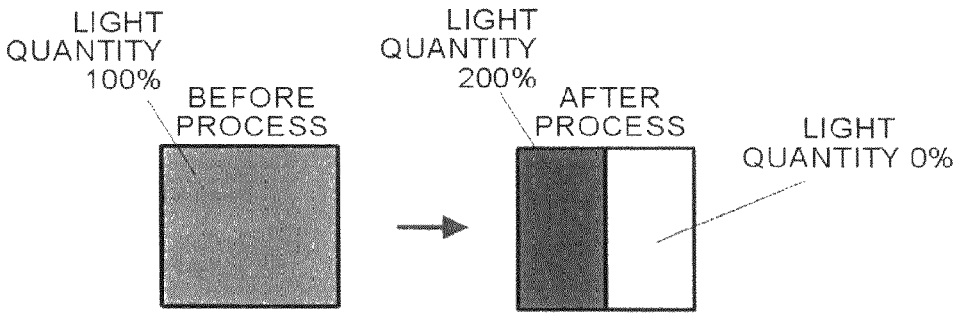
FIGS. 5A to 5C are diagrams for explaining specific examples (Nos. 1 to 3, respectively) of an adjustment process of the irradiation time and the irradiation quantity of light when specific pixels are formed.
Figure 5B:
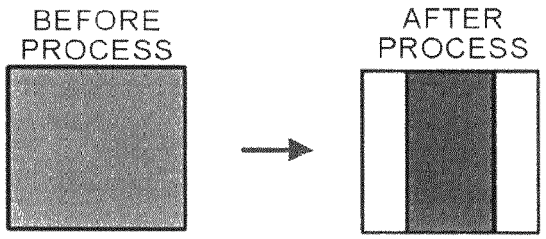
Figure 5C:
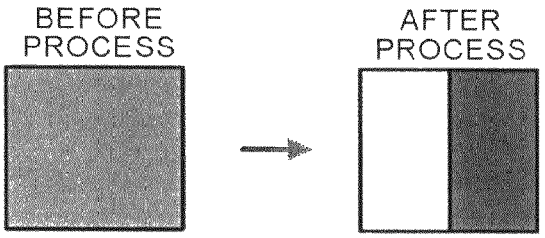

For example, FIG. 5A illustrates states before and after a process of setting the pulse width to a duty ratio of 50% and the phase to the left phase, for the specific pixels. FIG. 5B illustrates states before and after a process of setting the pulse width to a duty ratio of 50% and the phase to the central phase, for the specific pixels. FIG. 5C illustrates states before and after a process of setting the pulse width to a duty ratio of 50% and the phase to the right phase, for the specific pixels.

The following describes a method for generating drive current data (amplitude data of the drive signal) with the drive signal generating unit 29. The drive current data refers to a signal specifying how much drive current value is to be supplied to the LD 14, that is, how much amount of light is to be output from the LD 14.

First, normal light quantity current data (a set value of the drive current to form the normal pixels) is read from the normal current setting unit 29*f*. The "normal light quantity current data" refers to data for determining a predetermined light quantity that serves as a light quantity of the normal pixels. The "predetermined light quantity" refers to a light quantity at which an appropriate amount of deposited toner is obtained to form a solid image by optically scanning the photoconductor drum 1030.

Then, power modulation light quantity current data (a set value of the drive current to form the specific pixels) is read from the power modulation current setting unit 29*g*. The "power modulation light quantity current data" refers to data for determining to how much amount the light quantity of the specific pixels is to be set. The amount is set based on the normal light quantity current data, and a change in the normal light quantity current data leads to an adjustment of the power modulation light quantity current data.

Specifically, the power modulation light quantity current data can be set to an integral multiple of the normal light quantity current data, for example. The multiplying factor is preferably determined based on the characteristics of, for example, the photoconductor drum, the toner, and the developing.

Then, in response to the pixel clock, the drive signal generator 29*h* generates the drive current data that serves as the power modulation light quantity current data at the time of forming the specific pixels and serves as the normal light quantity current data at the time of forming the normal pixels.

As is understood from the above description, the drive signal for driving the LD 14 includes the modulated pulse signal and the drive current data.

As will be described below by way of a specific example, the present embodiment applies predetermined processing (an adjustment process of the irradiation time and the irradiation quantity of light) to edges of the image data.

Figure 6A:
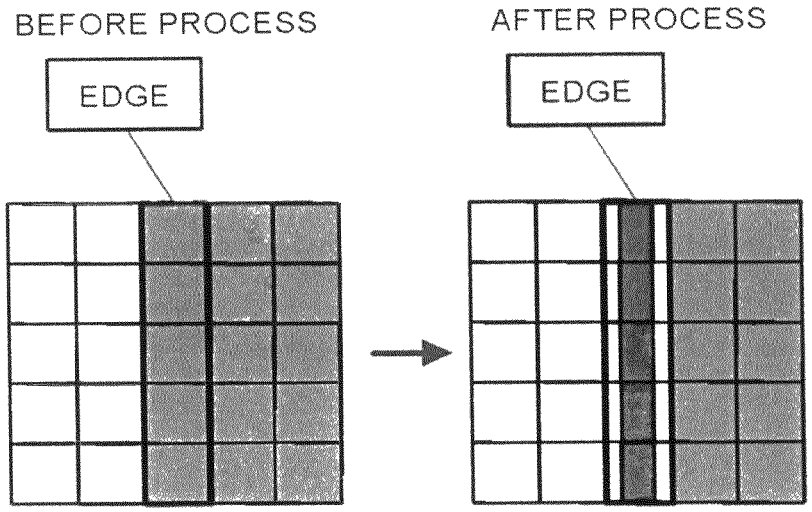
FIGS. 6A and 6B are diagrams for explaining specific examples (Nos. 1 and 2, respectively) of the adjustment process of the irradiation time and the irradiation quantity of light to an edge of an image.
Figure 6B:
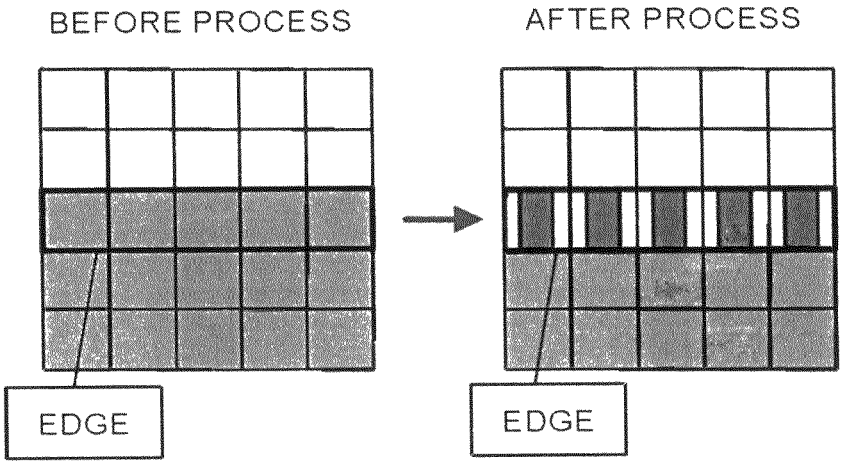

FIGS. 6A and 6B illustrate an example of the processing to a plurality of specific pixels when the specific pixels constitute edges in the main-scanning direction and the sub-scanning direction of the image data. FIG. 6A illustrates an enlarged view of an area including an edge in the main-scanning direction of the image data. FIG. 6B illustrates an enlarged view of an area including an edge in the sub-scanning direction of the image data.

In this process, the width in the main-scanning direction of each of the specific pixels is reduced, and the LD 14 emits light at a higher emitted light quantity (emitted light intensity) level than the normal emitted light quantity level. Specifically, the width in the main-scanning direction of each of the specific pixels is set to a half the main-scanning direction of the normal pixels, and the emitted light quantity is set to 200% of the light quantity emitted from the normal pixels. The phase in each of the specific pixels is set to be the central phase.

Figure 7A:
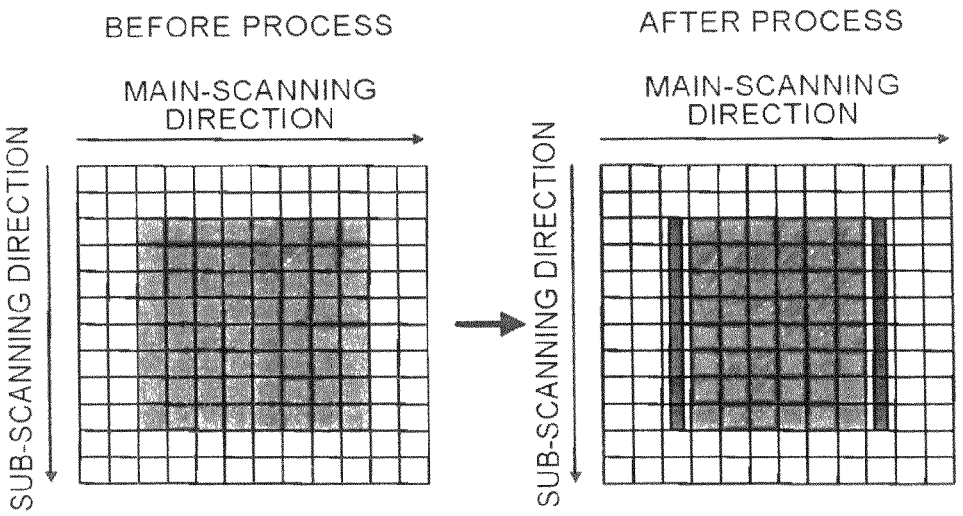
FIGS. 7A and 7B are diagrams (Nos. 1 and 2, respectively) for explaining specific examples of the adjustment process of the irradiation time and the irradiation quantity of light to an edge of a solid image.
Figure 7B:
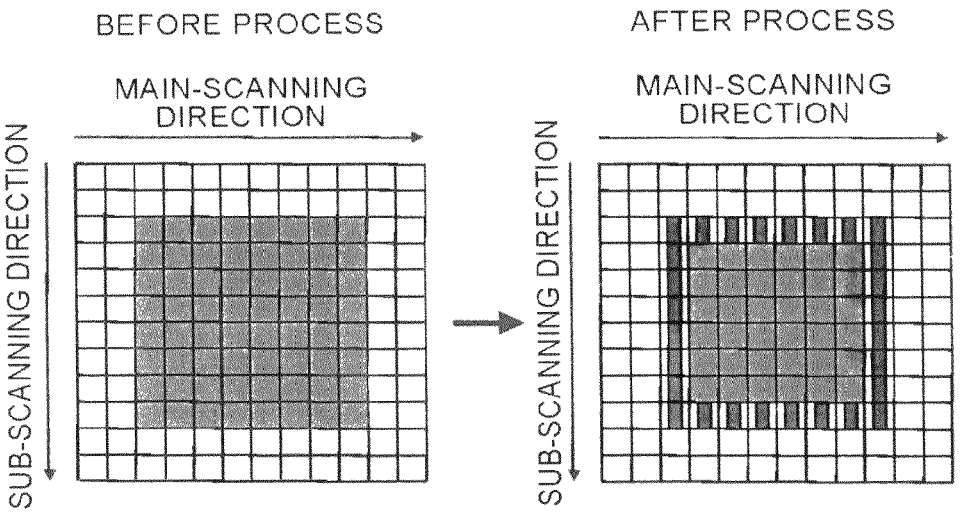

FIGS. 7A and 7B illustrate specific examples before and after the process is applied to certain image data (such as solid image data). In FIG. 7A, the process is applied to only the edges in the main-scanning direction, and in FIG. 7B, the process is applied to the edges in the main-scanning direction and the edges in the sub-scanning direction.

Figure 8A:
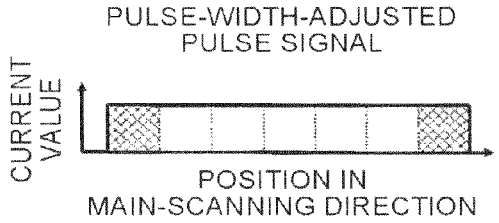
FIG. 8A is a diagram (No. 1) illustrating a specific example of a pulse-width-adjusted pulse signal.

FIG. 8A illustrates a waveform of a pulse-width-adjusted pulse signal (here, a rectangular pulse signal corresponding to seven pixels).

Figure 8B:
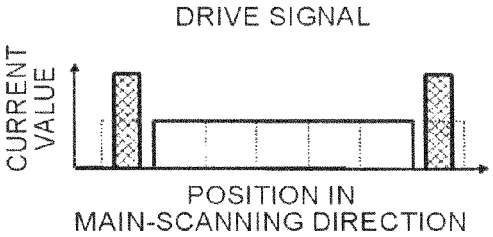
FIGS. 8B to 8D are diagrams (Nos. 1 to 3) illustrating specific examples of a drive signal.

FIG. 8B illustrates a waveform of a drive signal generated by applying a process of amplitude increase and pulse width reduction to a portion of the pulse-width-adjusted pulse signal corresponding to one of the specific pixels included in an edge in the main-scanning direction of the image.

In FIG. 8B, a hatched portion represents the portion of the drive signal corresponding to one of the specific pixels, and a white square portion represents a portion of the drive signal corresponding to one of the normal pixels. In FIG. 8B, the portion of the drive signal corresponding to one of the specific pixels has a duty ratio of 50% and a current value (amplitude value) of 200% relative to those of the portion corresponding to one of the normal pixels. In other words, the product of the amplitude and the pulse width (the area of the hatched portion) of the portion corresponding to one of the specific pixels is equal to the product of the amplitude and the pulse width (the area of the square portion) of the portion corresponding to one of the normal pixels. The phase is the central phase. As a result, the example of FIG. 8B can sharpen the edges in the main-scanning direction of the image, and can improve the reproducibility of the image. In contrast, using the unprocessed reference pulse signal to form an image cannot sharpen the edges in the main-scanning direction of the image, and results in lower reproducibility of the image.

Figure 8C:
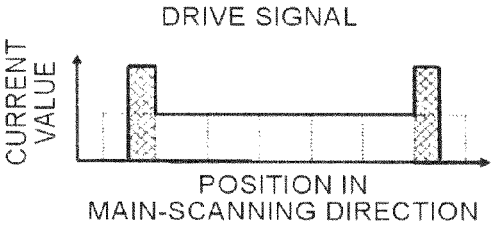

FIG. 8C illustrates a signal waveform of the drive signal when the phase in the FIG. 8B is shifted toward the center in the main-scanning direction. In this case, the same effect as that of the example of FIG. 8B is obtained, and the current off time in the process of forming the image is eliminated, so that an area of weak electric field causing unstable toner condensation can be reduced.

Figure 8D:
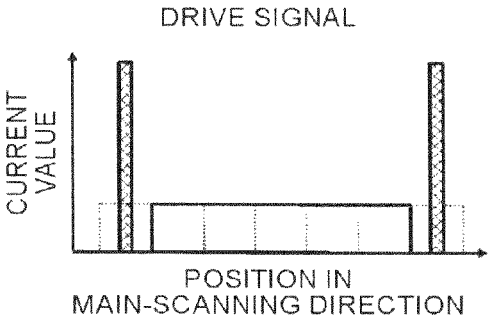

In FIG. 8D, the portion of the drive signal corresponding to one of the specific pixels included in an edge in the main-scanning direction of the image has the same phase (central phase) as that of the FIG. 8B, and a duty ratio of 25% and a current value (amplitude value) of 400% relative to those of the portion corresponding to one of the normal pixels. In other words, the product of the amplitude and the pulse width (the area of the hatched portion) of the portion corresponding to one of the specific pixels is equal to the product of the amplitude and the pulse width (the area of the square portion) of the portion corresponding to one of the normal pixels. In this case, the same effect as that of the example of FIG. 8B is obtained, and the edges are more highlighted, so that toner scattering can be prevented, and improved sharpness and stable density can be obtained.

Figure 9A:
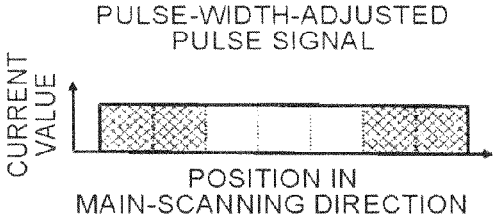
FIG. 9A is a diagram (No. 2) illustrating a specific example of the pulse-width-adjusted pulse signal.

FIG. 9A illustrates a signal waveform of a pulse-width-adjusted pulse signal (here, a rectangular pulse signal corresponding to seven pixels).

Figure 9B:
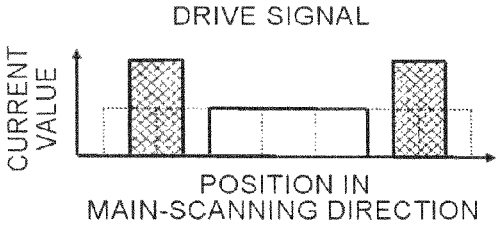
FIGS. 9B to 9D are diagrams (Nos. 4 to 6) illustrating specific examples of the drive signal.

FIG. 9B illustrates a waveform of a drive signal generated by applying a process of amplitude increase and width reduction to portions of the pulse-width-adjusted pulse signal corresponding to two of the specific pixels included in an edge in the main-scanning direction of the image. In FIG. 9B, a hatched portion represents the portions of the drive signal corresponding to two of the specific pixels, and a white square portion represents a portion of the drive signal corresponding to one of the normal pixels. In FIG. 9B, the portions of the drive signal corresponding to two of the specific pixels have a duty ratio of 50% and a current value (amplitude value) of 200% relative to those of the portions corresponding to two of the normal pixels. In other words, the product of the amplitude and the pulse width (the area of the hatched portion) of the portions corresponding to two of the specific pixels is equal to the product of the amplitude and the pulse width (the area of two square portions) of the portions corresponding to two of the normal pixels. The portions corresponding to two of the specific pixels are adjacent to and united with each other in the main-scanning direction. In this case, the same effect as that of the example of FIG. 8B is obtained.

Figure 9C:
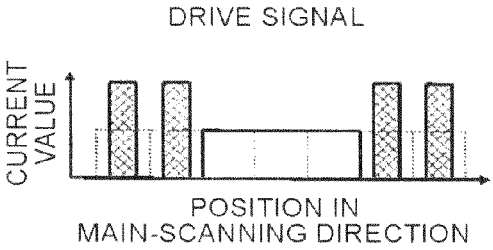

FIG. 9C illustrates a signal waveform of the drive signal when the portions corresponding to two of the specific pixels in FIG. 9B are separated in the main-scanning direction. In this case, the same effect as that of the example of FIG. 8B is obtained.

Figure 9D:
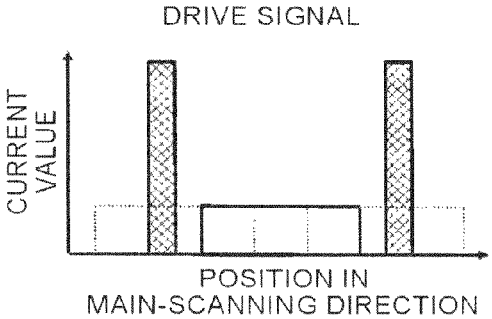

In FIG. 9D, the portions of the drive signal corresponding to two of the specific pixels included in an edge in the main-scanning direction of the image have a duty ratio of 25% and a current value (amplitude value) of 400% relative to those of the portions corresponding to two of the normal pixels. In other words, the product of the amplitude and the pulse width (the area of the hatched portion) of the portions corresponding to two of the specific pixels is equal to the product of the amplitude and the pulse width (the area of the two square portions) of the portions corresponding to two of the normal pixels. In this case, the same effect as that of the example of FIG. 8B is obtained, and the edges are more highlighted, so that the toner scattering can be prevented, and improved sharpness and stable density can be obtained.

If, for example, the specific pixel phase setting unit 29*b* sets the phase of a portion of the pulse-width-adjusted pulse signal corresponding to a specific pixel included in the left edge of the image to be the right phase, and the phase of a portion of the pulse-width-adjusted pulse signal corresponding to a specific pixel included in the right edge of the image to be the left phase (refer to FIG. 8C), the edges at both ends in the main-scanning direction of the image are positioned inside the desired positions, so that the width in the main-scanning direction of the image is slightly smaller than a desired width. In this case, there is room for improvement of the reproducibility of the image.

Figure 10A:
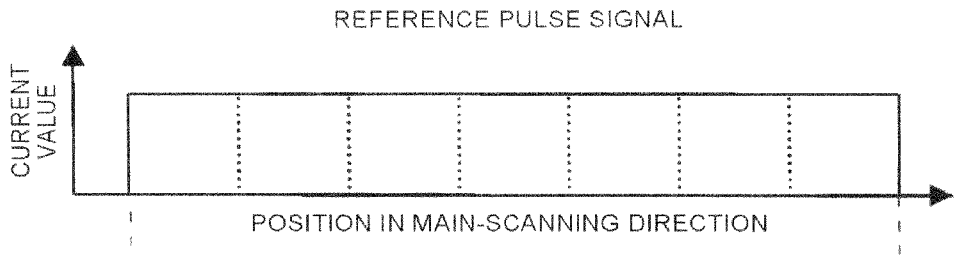
FIG. 10A is a diagram illustrating a reference pulse signal.
Figure 10B:
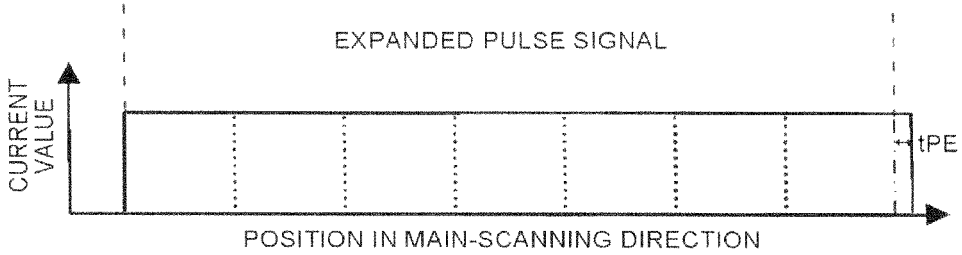
FIG. 10B is a diagram illustrating an expanded pulse signal.

Hence, before the drive signal is generated, the pulse width adjusting unit 29*c* sets (finely adjusts) the pulse width of the reference pulse signal (refer to FIG. 10A) to be slightly larger (refer to FIG. 10B) so as to be able to approximate the width in the main-scanning direction of the formed image to the desired width. In other words, the reproducibility of the image can be improved. The symbol tPE in FIG. 10B represents the amount of expansion of the pulse width (pulse expansion amount).

Figure 11:
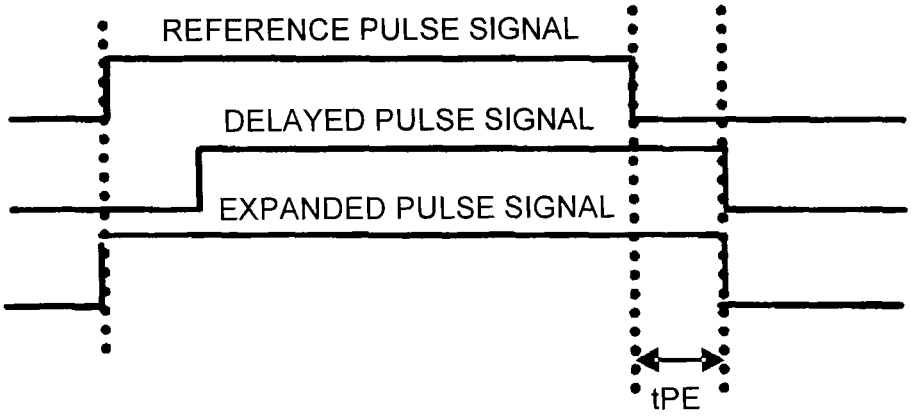
FIG. 11 is a diagram for explaining an example of a method for generating the expanded pulse signal.

The pulse width of the reference pulse signal can be expanded by generating an expanded pulse signal by taking the logical OR of the reference pulse signal and a delayed pulse signal obtained by delaying the reference pulse signal, for example, as illustrated in FIG. 11.

If, for example, the specific pixel phase setting unit 29*b* sets the phase of the portion of the pulse-width-adjusted pulse signal corresponding to the specific pixel included in the left edge of the image to be the left phase, and the phase of the portion of the pulse-width-adjusted pulse signal corresponding to the specific pixel included in the right edge of the image to be the right phase, the edges at both ends in the main-scanning direction of the image are highlighted, resulting in a slightly larger width in the main-scanning direction of the image than the desired width. In this case, there is room for improvement of the reproducibility of the image.

Hence, before the drive signal is generated, the pulse width adjusting unit 29*c* sets (finely adjusts) the pulse width of the reference pulse signal (refer to FIG. 12A) to be slightly smaller (refer to FIG. 12B) so as to be able to approximate the width in the main-scanning direction of the formed image to the desired width. In other words, the reproducibility of the image can be improved. The symbol tPS in FIG. 12B represents the amount of shortening of the pulse width.

Figure 13:
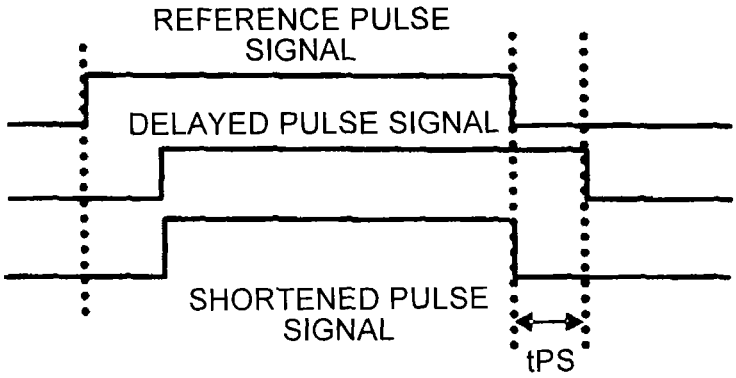
FIG. 13 is a diagram for explaining an example of a method for generating the shortened pulse signal.

The pulse width of the reference pulse signal can be shortened by generating a shortened pulse signal by taking the logical AND of the reference pulse signal and the delayed pulse signal obtained by delaying the reference pulse signal, for example, as illustrated in FIG. 13.

Figure 12A:
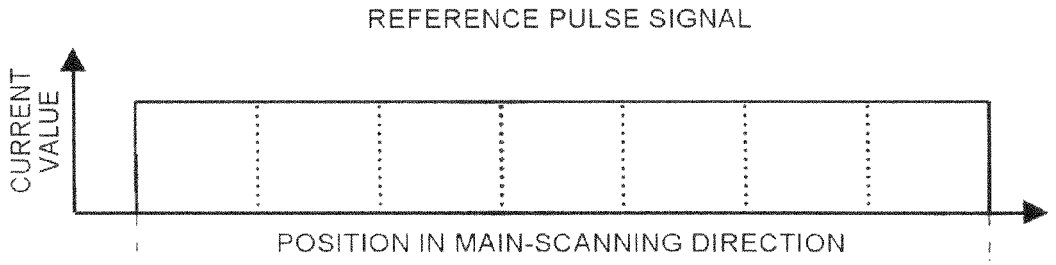
FIG. 12A is a diagram illustrating the reference pulse signal.
Figure 12B:
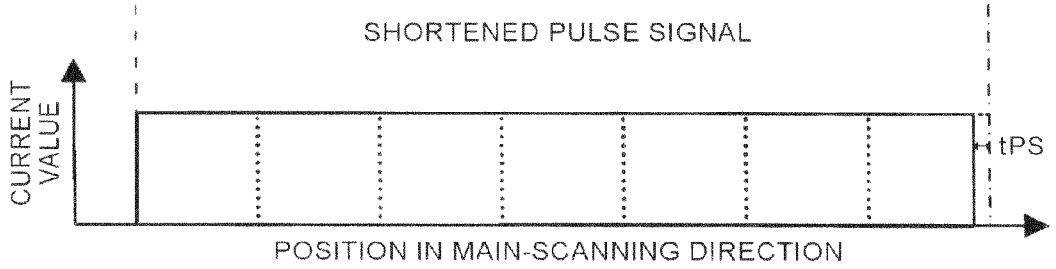
FIG. 12B is a diagram illustrating a shortened pulse signal.

In FIGS. 10B and 12B the drive signal generating unit 29 adjusts the pulse width of the reference pulse signal by adjusting the pulse width of a portion of the reference pulse signal corresponding to one pixel of a plurality of pixels. However, the adjustment method is not limited to this method, but all that is necessary is that the pulse width of the reference pulse signal be adjusted by adjusting the pulse width of a portion of the reference pulse signal corresponding to at least one pixel.

The width in the main-scanning direction of the formed image can be approximated to a certain degree to the desired width by appropriately selecting and setting one of, for example, the left phase, the right phase, and the central phase as the phase of a portion of the pulse-width-adjusted pulse signal corresponding to a specific pixel (as the position of a portion thereof corresponding to a specific pixel reduced in pulse width) included in an edge in the main-scanning direction of the image. However, as will be understood by referring to the following specific example, the width of the formed image is difficult to be finely adjusted so as to be as close as possible to the desired width.

For example, in the case of forming an image at a resolution of 1200 dpi, the pulse width of the portion of the reference pulse signal corresponding to a normal pixel is set to approximately 21 μm, and the pulse width of the portion of the reference pulse signal corresponding to a specific pixel is set roughly from a quarter to a half the pulse width of the portion corresponding to a normal pixel (roughly 5 μm to 10 μm). The pulse width of the reference pulse signal adjusted by the pulse width adjusting unit 29*c* is set to a value (such as 1 μm to 5 μm) smaller than the pulse width (such as 5 μm to 10 μm) of the portion corresponding to a specific pixel.

As a result, the pulse width adjusting unit 29*c* finely adjusts the width in the main-scanning direction of the image so as to further improve the reproducibility of the image.

The laser printer 1000 of the present embodiment described above is an image forming apparatus that forms an image by scanning the photoconductor drum 1030 with light modulated according to image data, and includes the LD 14 that emits the light and the drive signal generating unit 29 that generates a drive signal for driving the LD 14 based on a reference pulse signal serving as a reference to form a plurality of pixels arranged in the main-scanning direction of the image. The drive signal generating unit 29 generates the drive signal by adjusting the pulse width of the reference pulse signal so that the amplitude of portions of the reference pulse signal with the adjusted pulse width corresponding to specific pixels among the pixels is larger than the amplitude of the portions of the reference pulse signal with the adjusted pulse width corresponding to normal pixels that are pixels other than the specific pixels among the pixels, and so that the pulse width of the portions of the reference pulse signal with the adjusted pulse width corresponding to the specific pixels is smaller than the pulse width of the portions of the reference pulse signal with the adjusted pulse width corresponding to the normal pixels.

In this case, the specific pixels can be shaper than the normal pixels, and the reproducibility of the width in the main-scanning direction of the image can be improved.

As a result, the image reproducibility of the laser printer 1000 can be improved.

In addition, the laser printer 1000 can reduce density unevenness of the image caused by variation in a development field in the main-scanning direction on the photoconductor drum 1030.

Figure 14A:
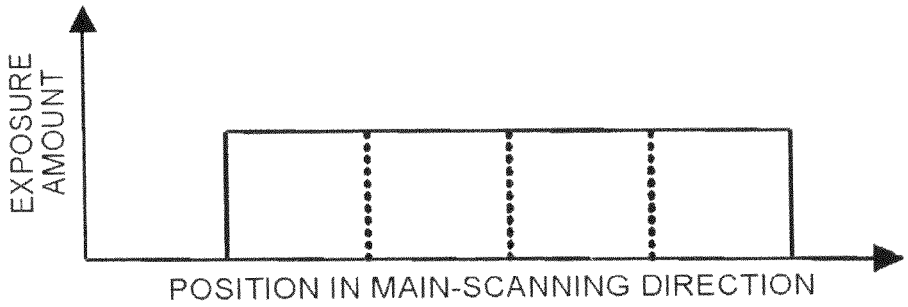
FIG. 14A is a graph illustrating exposure amounts in various positions in the main-scanning direction of a photoconductor drum of a comparative example.
Figure 14B:
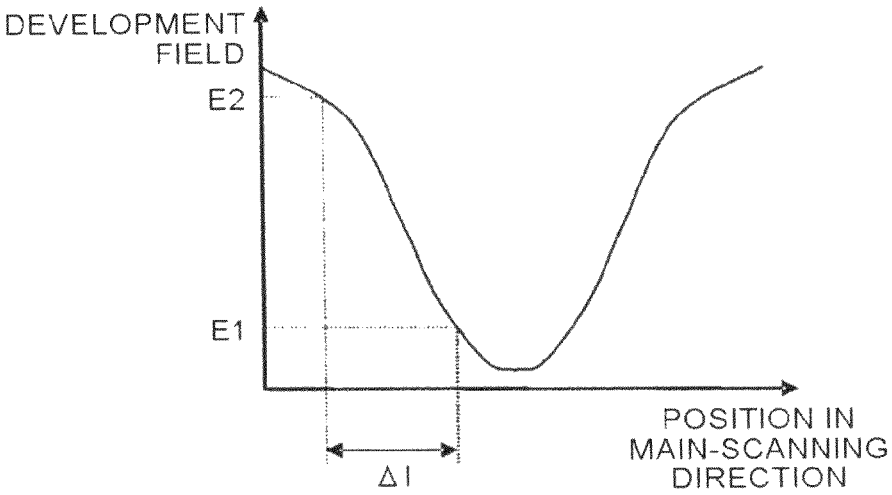
FIG. 14B is a graph illustrating a variation in a development field in the main-scanning direction on the photoconductor drum of the comparative example.

An operation of the laser printer 1000 according to the present embodiment will be described by way of a specific example. FIGS. 14A and 14B illustrate an optical waveform and a variation in the development field in the main-scanning direction obtained when the photoconductor drum is optically scanned in a comparative example. In this example, as is understood from FIG. 14A, the surface of the photoconductor drum is scanned in the main-scanning direction with the optical waveform at a constant exposure amount using the reference pulse signal, so that, as illustrated in FIG. 14B, a wide area (Δ1) of weak electric field causing unstable toner condensation (area between E1 and E2) is generated. This phenomenon results in a wide area causing unstable toner condensation, leading to unevenness in the amount of deposited toner, causing the density unevenness of the image on the recording sheet. The unevenness in the amount of deposited toner reduces the sharpness of edges of a line drawing.

Figure 15A:
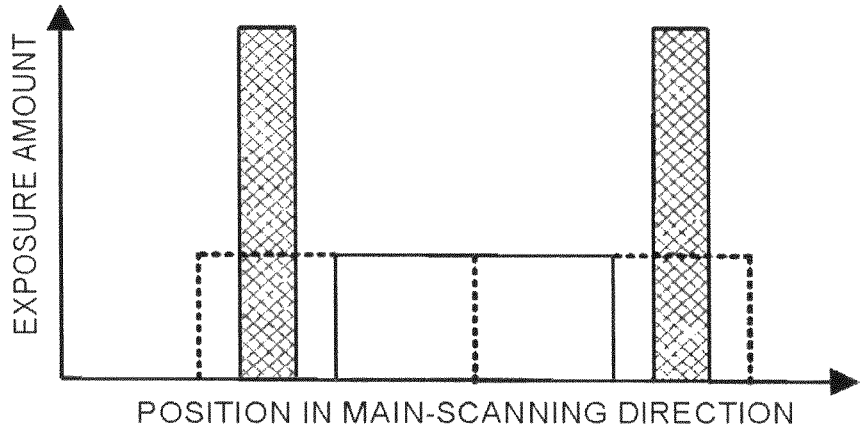
FIG. 15A is a graph illustrating the exposure amounts in the various positions in the main-scanning direction of a photoconductor drum of the embodiment.
Figure 15B:
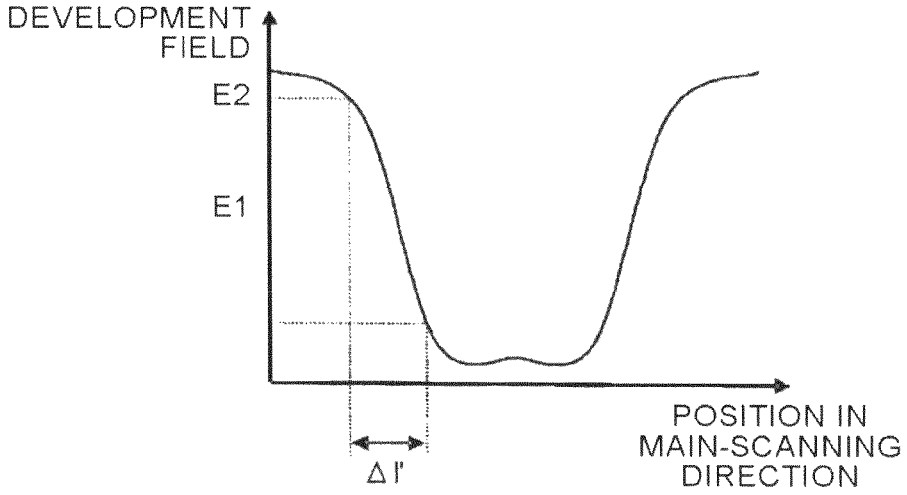
FIG. 15B is a graph illustrating a variation in the development field in the main-scanning direction on the photoconductor drum of the embodiment.

FIGS. 15A and 15B illustrate the optical waveform and the variation in the development field in the main-scanning direction obtained when the photoconductor drum is optically scanned in an example of the present embodiment. In FIG. 15A, the LD 14 emits a larger quantity of light when forming the pixels at the edges than when forming the normal pixels, so that the variation in the development field can be steeper. Consequently, as illustrated in FIG. 15B, the length in the main-scanning direction of the area of weak electric field causing unstable toner condensation (area between E1 and E2) can be set to Δ1' (<Δ1), and thus, the area causing unstable toner condensation can be narrowed. As a result, the unevenness of the toner condensation can be reduced, so that the stability of the toner density can be improved, and the sharpness of the edges of the line drawing can also be improved. Moreover, the pulse width is reduced, so that an appropriate amount of exposure energy can be maintained without a significant increase in the total amount of the exposure energy.

By setting the specific pixels to be pixels included in the edges in the main-scanning direction of the image, the sharpness of the edges can be increased, and the reproducibility of the width in the main-scanning direction of the image can be further improved.

By setting in advance the positions of the portions corresponding to the specific pixels with respect to the main-scanning direction when the pulse width of the portions corresponding to the specific pixels is reduced to be smaller than that of the portions corresponding to the normal pixels, and adjusting the pulse width of the reference pulse signal based on the positions thus set, the reproducibility of the width in the main-scanning direction of the image can be still further improved.

By setting the adjusted value of the pulse width of the reference pulse signal to a value equal to or smaller than the pulse width of the portions corresponding to the specific pixels when the pulse width thereof is reduced to be smaller than that of the portions corresponding to the normal pixels, the width in the main-scanning direction of the image can be finely adjusted, and thus, the reproducibility of the width in the main-scanning direction of the image can be still further improved.

The product of the amplitude and the pulse width of the portions corresponding to the specific pixels having the larger amplitude and the smaller pulse width than those of the portions corresponding to the normal pixels is approximately equal to the product of the amplitude and the pulse width of the portions corresponding to the normal pixels, so that the exposure energy can be kept constant during formation of the normal pixels and the specific pixels, and thus, the density unevenness of the image can be reduced.

The following describes a modification of the embodiment described above with reference to FIGS. 17 to 19. The description of the present modification will focus on differences from the embodiment described above.

In the present modification, current values (amplitude values) are individually set for a pre-lighting signal PS, an overshoot signal OVS, and an undershoot signal UDS, which are then added to a pulsed drive signal. As a result, a supply current (current supplied to the LD 14) obtained by adding a pre-lighting current PC, an overshoot current OVC, and an undershoot current UDC to a pulsed drive current is generated (refer to FIG. 18). In the present modification, when the drive signal is generated, the pulse width adjustment, the phase setting, and the amplitude adjustment may be, but need not be, applied to the portions corresponding to the specific pixels in the same manner as the embodiment described above.

The pre-lighting current PC can charge parasitic capacitance of the LD 14 and the LD drive unit 31 in advance, and can thus improve a rising response of the optical waveform to a rise of the drive current. The overshoot current OVC can further improve the rising response of the optical waveform to the rise of the drive current. The undershoot current UDC can improve a falling response of the optical waveform to a fall of the drive current.

To apply the pulse width adjustment and the amplitude adjustment to the portions corresponding to the specific pixels, the light source control circuit only needs to include the reference pulse generating unit, the pulse width adjusting unit, the specific pixel phase setting unit, the specific pixel control unit, the modulated pulse generating unit, the normal current setting unit, the power modulation current setting unit, the drive signal generator, and the LD drive unit. Also in this case, the pulse width adjustment, the phase setting, and the amplitude adjustment only need to be applied to the portions corresponding to the specific pixels after the pulse width adjusting unit has applied a pulse expanding function (pulse width expanding function) and a pulse shortening function (pulse width shortening function).

If neither the pulse width adjustment nor the amplitude adjustment is intended to be applied to the portions corresponding to the specific pixels, the light source control circuit only needs to include the reference pulse generating unit, the pulse width adjusting unit, and a supply current generating unit that generates the supply current to be supplied to the LD based on the reference pulse signal with the pulse width thereof adjusted by the pulse width adjusting unit and that includes at least the LD drive unit.

A method for generating the supply current to the LD in a comparative example will first be described with reference to FIG. 17.

Although the supply current may be a binary signal for turning on/off each of the pixels, the supply current is more elaborately configured in this comparative example.

Specifically, in the comparative example, as illustrated in the right-hand diagram of FIG. 17, in order to form an optical waveform from which an optimal exposure amount is obtained, the supply current is configured as follows: the pre-lighting current PC is added to the pulsed drive current immediately before it rises; the overshoot current OVC is added to the pulsed drive current when it rises; and the undershoot current UDC is added to the pulsed drive current when it falls.

In the comparative example, the supply current is generated by generating the pre-lighting signal PS that controls the timing and duration of the pre-lighting current PC, the overshoot signal OVS that controls the timing and duration of the overshoot current OVC, and the undershoot signal UDS that controls the timing and duration of the undershoot current UDC, and setting the current values of the pre-lighting current PC, the overshoot current OVC, and the undershoot current UDC to appropriate values.

Figure 17:
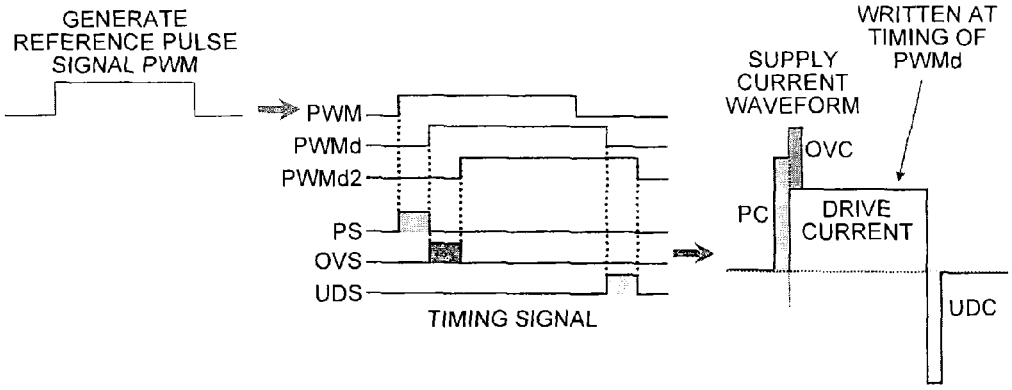
FIG. 17 is a diagram for explaining a method for generating a drive current of the comparative example.

The pre-lighting signal PS, the overshoot signal OVS, and the undershoot signal UDS are generated, as illustrated in the left-hand and central diagrams of FIG. 17, by generating a signal PWMd by delaying a generated reference pulse signal PWM by a certain time, and generating a signal PWMd2 by further delaying the signal PWMd.

While the delay circuit (buffer circuit) used in this comparative example can have various configurations, such as an inverter delay circuit and a current-controlled delay circuit, any configuration may be employed.

A method for generating the supply current in the present modification will be described with reference to FIG. 18. In the present modification, another delay circuit is added to the delay circuit of the comparative example.

Figure 18:
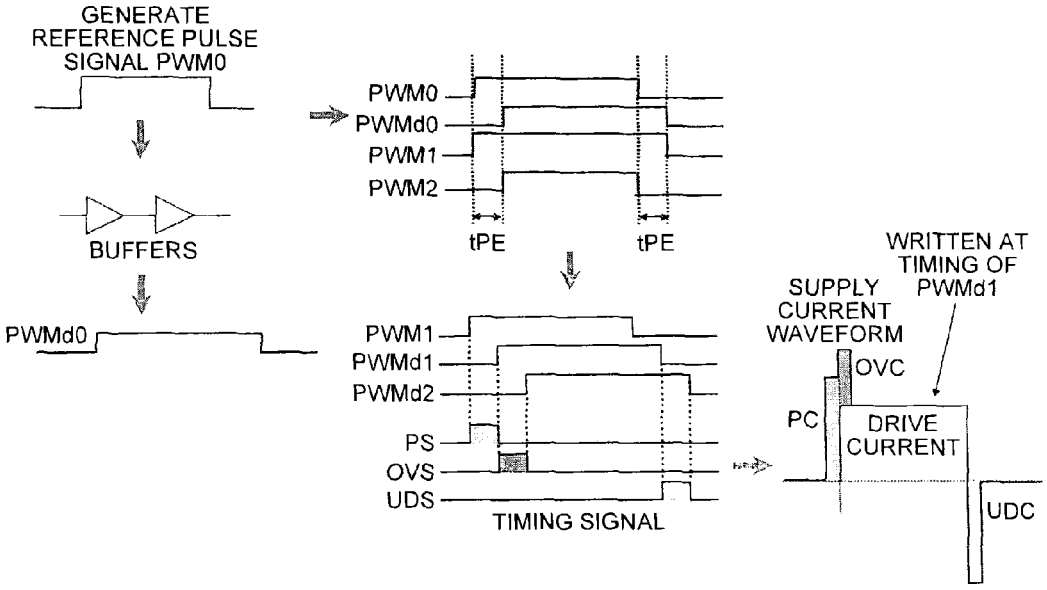
FIG. 18 is a diagram for explaining a method for generating the drive current of a modification of the embodiment.

Specifically, as illustrated in the left-hand and central diagrams of FIG. 18, an expanded pulse signal PWM1 is generated by taking the logical OR of a generated reference pulse signal PWM0 and a signal PWMd0 obtained by delaying the signal PWM0.

In this manner, by using the pulse expanding function to generate the expanded pulse signal PWM1 that is expanded from the reference pulse signal PWM0 by a desired length of the time tPE (such as roughly 1 ns to 2 ns), the lighting duration of the reference pulse signal PWM0 corresponding to all rows of pixels can be uniformly increased by the time tPE, so that the duration, and consequently the energy, of exposure can be corrected by a large amount.

While the setting of tPE varies depending on, for example, the light source (LD), the driver circuit (LD drive unit), the photoconductor, and developing conditions, the value of lacking exposure energy is determined when the system is built. Hence, the value only needs to be stored in a memory, such as a register, and to be read at the time of operation or set in advance. In this case, the duration of exposure is uniformly increased by the time tPE, which may be uniformly added without problem because the duration of exposure may lack mostly when the lighting duration is short.

The time tPE has almost no effect in the case of long-pulsed lighting (the pulse width of the reference pulse signal is large), and hence is effective in the correction of the duration of exposure in the case of short-pulsed lighting (the pulse width of the reference pulse signal is small). Consequently, the pulse expanding function is applied to the reference pulse signal in the case of the short-pulsed lighting, but needs not be applied to the reference pulse signal in the case of the long-pulsed lighting.

In the present modification, the pulse expanding function has the configuration in which the delay circuit is used. The pulse expanding function may, however, have other configurations, such as a configuration in which a counter using a high-frequency clock is used.

The pulse shortening function of reducing the pulse width will be described with reference to FIG. 18.

As illustrated in the central diagram of FIG. 18, the pulse shortening function of reducing the pulse width by the desired time tPE can be implemented by taking the logical AND of PWM0 and PWMd0, and thus, a shortened pulse signal PWM2 can be generated. In this case, in a similar manner to the case of the pulse expanding function, the duration of exposure is uniformly reduced by the time tPE, which may be uniformly subtracted without problem because the duration of exposure may be excessive mostly when the lighting duration is short. The time tPE has almost no effect on the long-pulsed lighting, and hence is effective in the correction of the duration of exposure in the short-pulsed lighting operation. Consequently, the pulse shortening function is applied to the reference pulse signal in the case of the short-pulsed lighting, but needs not be applied to the reference pulse signal in the case of the long-pulsed lighting.

Also in the present modification, the pulse expanding function or the pulse shortening function is applied to the reference pulse signal, and then, in the same manner as in the comparative example, the pre-lighting current PC, the overshoot current OVC, and the undershoot current UDC are added to the drive current to generate the supply current (refer to the central and right-hand diagrams of FIG. 18). After the pulse expanding function is applied, the pre-lighting current PC, the overshoot current OVC, and the undershoot current UDC are added by generating a delayed pulse signal PWMd1 obtained by delaying the expanded pulse signal PWM1, and then generating a pulse signal PWMd2 obtained by delaying the delayed pulse signal PWMd1 (refer to the central diagram of FIG. 18). After the pulse shortening function is applied, the pre-lighting current PC, the overshoot current OVC, and the undershoot current UDC are added in the same manner.

A description will be given, with reference to FIG. 19, of an example in which the pulse expanding function or the pulse shortening function described above is particularly required.

Figure 19:
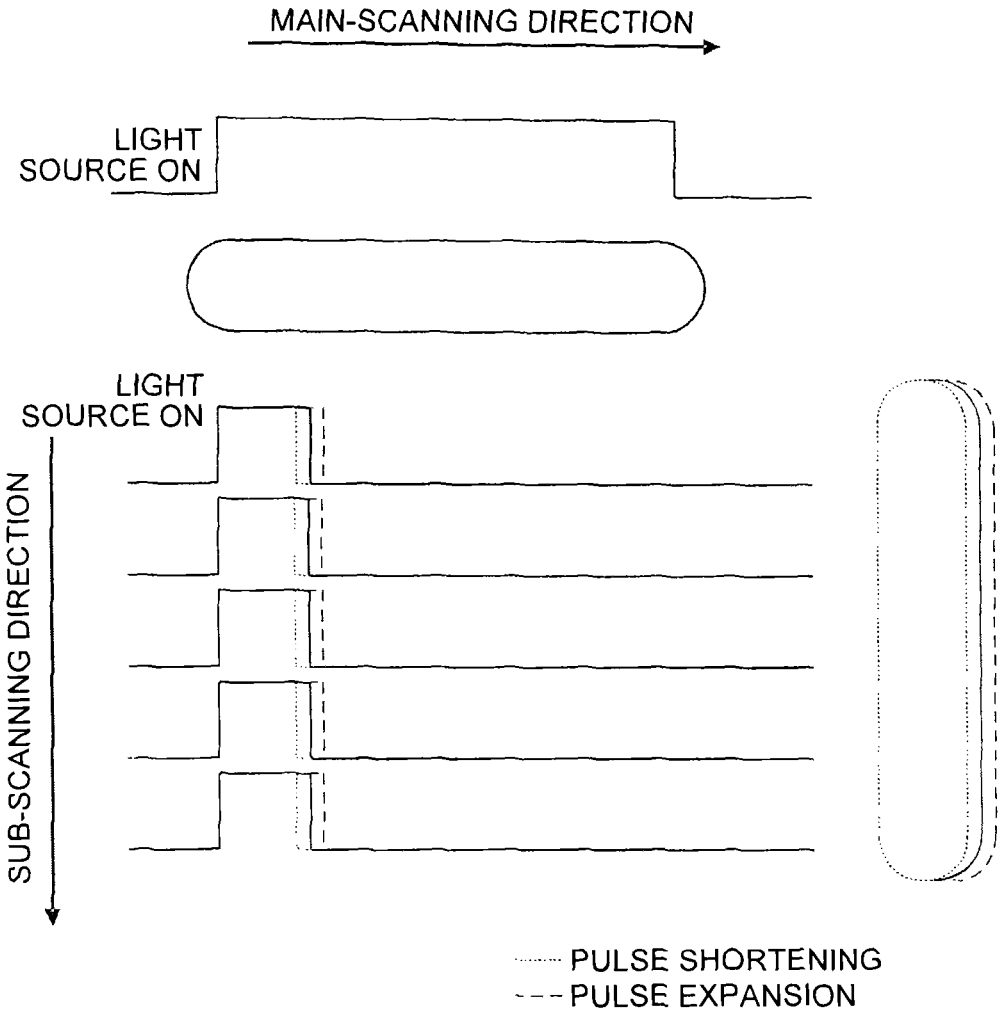
FIG. 19 is a diagram for explaining an example in which a pulse expanding function or a pulse shortening function needs to be used.

FIG. 19 illustrates images of a vertical line and a horizontal line obtained by raster-scanning the scanned surface with a light beam. When the horizontal line is formed, that is, during the scanning in the raster direction (main-scanning direction), the light beam scans the surface while having a width as wide as the spread of the beam. Consequently, to adjust the width (vertical width) of the horizontal line, for example, the exposure amount or the beam diameter needs to be changed. Thus, in general, the adjustment is not easy.

When the vertical line is formed, that is, during the scanning in the direction (sub-scanning direction) orthogonal to the raster direction, the width (horizontal width) of the vertical line can be adjusted by adjusting the lighting duration of the light source (LD). Consequently, the width of the vertical line can be freely adjusted by using the pulse expanding function or the pulse shortening function. In this case, the ratio between the widths of the vertical and the horizontal lines can be freely adjusted, and the widths of the vertical and the horizontal lines can be adjusted to be equal to each other, which is necessary, in particular, for accurate printers for drafting or the like.

In the modification described above, the pre-lighting current PC, the overshoot current OVC, and the undershoot current UDC are added to the drive current to generate the supply current. However, the method for generating the supply current is not limited to this method, but what is important is that at least one of the pre-lighting current PC, the overshoot current OVC, and the undershoot current UDC is preferably added to the drive current.

In the embodiment and the modification thereof describe above, the optical scanning device is used as an exposure device that exposes the photoconductor drum to light. The exposure device is, however, not limited to this example. An optical print head may be used that includes a plurality of light-emitting units arranged separately from each other at least in the direction parallel to the longitudinal direction of the photoconductor drum. Specifically, a scanning exposure may be applied to the photoconductor drum 1030 by rotating the photoconductor drum relative to the light from the optical print head. In this case, for example, the pulse width of the reference pulse signal may be adjusted so that the pulse width of the portions of the reference pulse signal with the adjusted pulse width corresponding to the specific pixels of an image is smaller than the pulse width of the portions of the reference pulse signal with the adjusted pulse width corresponding to the normal pixels, and so that the amplitude of the portions of the reference pulse signal with the adjusted pulse width corresponding to the specific pixels of the image is larger than the amplitude of portions of the reference pulse signal with the adjusted pulse width corresponding to the normal pixels. In this case, the specific pixels are preferably pixels included in edges of the image, and more preferably pixels included in edges of the image in the direction of rotation of the photoconductor drum.

In the embodiment and the modification thereof, the pulse width of the reference pulse signal is adjusted based on the positions of the portions corresponding to the specific pixels with respect to the main-scanning direction when the pulse width of the portions is reduced to be smaller than that of the portions corresponding to the normal pixels. The pulse width of the reference pulse signal may, however, be adjusted without being based on such positions.

In the embodiment and the modification thereof, the adjusted value of the pulse width of the reference pulse signal is set to a value equal to or smaller than the pulse width of the portions of the reference pulse signal corresponding to the specific pixels when the pulse width thereof is reduced to be smaller than that of the portions of the reference pulse signal corresponding to the normal pixels. The adjusted value may, however, be larger than the pulse width of the portions corresponding to the specific pixels that is reduced to be smaller than that of the portions corresponding to the normal pixels.

In the embodiment and the modification thereof, the LD (edge-emitting laser diode) is used as the light source. The light source may, however, employ, for example, a laser other than an edge-emitting laser, such as a surface-emitting laser (VCSEL), a light-emitting diode (LED), or an organic electroluminescent (EL) device.

In the embodiment and the modification thereof, the adjustment of the amplitude and the pulse width is applied to the portions of the reference pulse signal with the adjusted pulse width corresponding to the specific pixels included in the edges of the image. The adjustment of the amplitude and the pulse width may, however, be applied to, instead of or in addition to these portions, portions of the reference pulse signal with the adjusted pulse width corresponding to specific pixels included in an intermediate portion of the image, in the same manner as in the case of the specific pixels included in the edges of the image.

In the embodiment and the modification thereof, the width of the edges of the image is set to one pixel width or two pixel widths of the specific pixels. The width of the edges is, however, not limited to this example, and may be set to three pixel widths or wider. Also in this case, the product of the pulse width and the amplitude of the portions of the drive signal corresponding to the specific pixels is preferably approximately equal to the product of the pulse width and the amplitude of the portions of the drive signal corresponding to the normal pixels.

In the embodiment and the modification thereof, the rectangular pulse signal is used as the reference pulse signal. The reference pulse signal is, however, not limited to this example, and may be a pulse signal, such as a trapezoidal pulse signal, having another shape.

In the embodiment and the modification thereof, the light source control circuit 23 includes the drive signal generating unit 29. The drive signal generating unit 29 may, however, be included in the image processing unit. In this case, the light source control circuit may include only the LD drive unit 31.

While the embodiment and the modification thereof employs the laser printer 1000 as the image forming apparatus of the present invention, the image forming apparatus is not limited to this example. The image forming apparatus of the present invention may be, for example, a color printer 2000 that includes a plurality of photoconductor drums as illustrated as an example in FIG. 16.

The color printer 2000 is a tandem multicolor printer that forms a full-color image by superimposing four colors (black, cyan, magenta, and yellow), and includes, for example, the following: a station for black (a photoconductor drum K1, a charging device K2, a developing device K4, a cleaning unit K5, and a transfer device K6); a station for cyan (a photoconductor drum C1, a charging device C2, a developing device C4, a cleaning unit C5, and a transfer device C6); a station for magenta (a photoconductor drum M1, a charging device M2, a developing device M4, a cleaning unit M5, and a transfer device M6); a station for yellow (a photoconductor drum Y1, a charging device Y2, a developing device Y4, a cleaning unit Y5, and a transfer device Y6); an optical scanning device 2010; a transfer belt 2080; and a fixing unit 2030.

Figure 16:
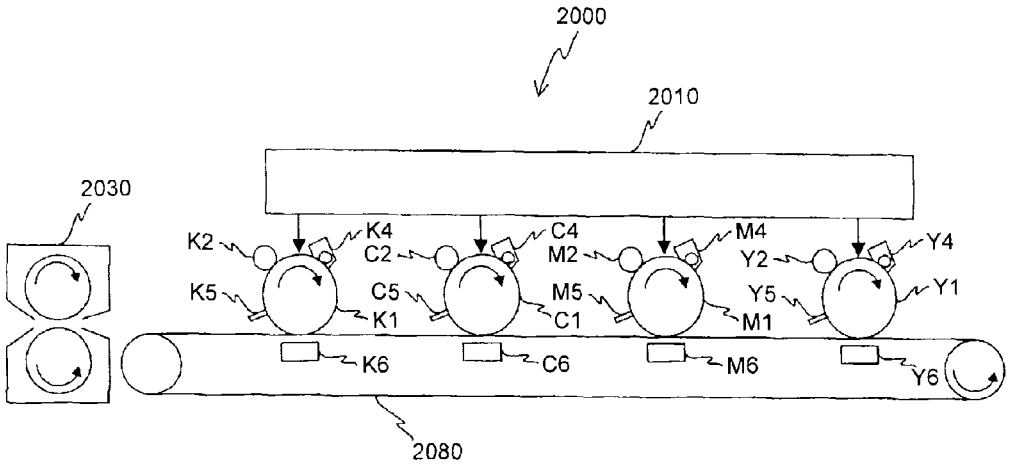
FIG. 16 is a diagram illustrating a schematic configuration of a color printer.

The photoconductor drums rotate in the directions of arrows in FIG. 16. The charging devices, the developing devices, the transfer devices, and the cleaning units are arranged around the respective photoconductor drums along the directions of rotation thereof. The respective charging devices uniformly charge the surfaces of the corresponding photoconductor drums. The optical scanning device 2010 irradiates the surfaces of the photoconductor drums charged by the charging devices with laser beams so as to form latent images on the respective photoconductor drums. Toner images are then formed on the surfaces of the photoconductor drums by the corresponding developing devices. Further, the toner images of the respective colors are transferred by the corresponding transfer devices onto the recording sheet on the transfer belt 2080, and the images are finally fixed by the fixing unit 2030 onto the recording sheet.

The optical scanning device 2010 includes the same LD as the LD 14 of the above-described embodiment for each of the colors, and includes a light source control circuit having the same configuration as that of the light source control circuit 23. As a result, the same effects as those of the optical scanning device 1010 can be obtained, and color shift can be reduced. The same effects as those of the laser printer 1000 can also be obtained because the color printer 2000 includes the optical scanning device 2010.

While the color printer 2000 has been described for the case in which the optical scanning device is configured in an integrated manner, the present invention is not limited to this case. For example, the optical scanning device may be provided for each of the image forming stations, or for each two of the image forming stations.

While the color printer 2000 has been described for the case of including the four photoconductor drums, the present invention is not limited to this case. For example, five or more of the photoconductor drums may be included.

The image forming apparatus of the present invention may be, for example, an image forming apparatus that directly projects laser beams onto a medium (such as a sheet) that is colored by the laser beams.

The image forming apparatus of the present invention may be an image forming apparatus that uses a silver halide film as an image bearer. In this case, optical scanning forms a latent image on the silver halide film. The latent image can be visualized by a process equivalent to a developing process in a normal silver halide photographic process, and can be transferred onto a photographic paper by a process equivalent to a printing process in the normal silver halide photographic process. Such an image forming apparatus can be made as an optical printing plate making apparatus or an optical drawing apparatus that draws, for example a computed tomography (CT) scan image.

The present invention can be applied to image forming apparatuses, such as digital copiers, in addition to the laser printer and the color printer described above. The essential point is that the present invention can be applied to image forming apparatuses that form an image by applying a scanning exposure to an image bearer (such as a photoconductor drum) with light modulated based on image information.

According to the present invention described above, the image reproducibility can be improved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus that forms an image by scanning an image bearer with light modulated based on image information, the image forming apparatus comprising:

a light source that emits the light; and circuitry configured to:

initially adjust a pulse width of a reference pulse signal;

generate a drive signal for driving the light source based on the reference pulse signal serving as a reference to form a plurality of pixels arranged in a main-scanning direction of the image;

subsequently adjust the pulse width of the reference pulse signal so that a first amplitude of a first portion or portions of the reference pulse signal corresponding to a specific pixel or pixels among the plurality of pixels is larger than a second amplitude of a second portion or portions of the reference pulse signal corresponding to a normal pixel or pixels, and so that a first pulse width of the first portion or portions of the reference pulse signal corresponding to the specific pixel or pixels is smaller than a second pulse width of the second portion or portions of the reference pulse signal corresponding to the normal pixel or pixels, the specific pixel or pixels being a part of the plurality of pixels, and the normal pixel or pixels being a pixel or pixels other than the specific pixel or pixels among the plurality of pixels; and generate the drive signal such that an amplitude of the drive signal corresponds to the first amplitude or the second amplitude for each of the plurality of pixels.

2. The image forming apparatus according to claim 1, wherein the specific pixel or pixels is/are a pixel or pixels included in an edge or edges in the main-scanning direction of the image.

3. The image forming apparatus according to claim 2, wherein the circuitry is configured to set in advance a position or positions of the first portion or portions corresponding to the specific pixel or pixels with respect to the main-scanning direction when the first pulse width of the first portion or portions corresponding to the specific pixel or pixels is reduced to be smaller than the second pulse width of the second portion or portions corresponding to the normal pixel or pixels, and adjust the pulse width of the reference pulse signal based on the position or positions thus set.

4. The image forming apparatus according to claim 1, wherein the pulse width of the reference pulse signal is adjusted by a value equal to or smaller than the first pulse width of the first portion or portions corresponding to the specific pixel or pixels when the first pulse width thereof is reduced to be smaller than the second pulse width of the second portion or portions corresponding to the normal pixel or pixels.

5. The image forming apparatus according to claim 1, wherein the circuitry is configured to initially adjust the pulse width of the reference pulse signal by adjusting a width of a portion of the reference pulse signal corresponding to at least one of the plurality of pixels.

6. The image forming apparatus according to claim 1, wherein a product of the first amplitude and the first pulse width of the first portion or portions corresponding to the specific pixel or pixels is approximately equal to a product of the second amplitude and the second pulse width of the second portion or portions corresponding to the normal pixel or pixels.

7. The image forming apparatus according to claim 1, wherein the circuitry is configured to detect the specific pixel or pixels based on an attribute of the image information.

8. The image forming apparatus according to claim 1, wherein the circuitry is configured to initially adjust the pulse width of the reference pulse signal by taking a logical AND or logical OR of a delayed pulse signal obtained by delaying the reference pulse signal and the reference pulse signal.

9. The image forming apparatus according to claim 1, wherein the light source includes a semiconductor laser.

10. The image forming apparatus according to claim 9, wherein the semiconductor laser is a surface-emitting laser.

11. The image forming apparatus according to claim 1, wherein the circuitry is configured to:

detect the specific pixel or pixels out of the plurality of pixels of the image data, and control a lighting duration and lighting timing of the light source when the specific pixel or pixels is/are formed;

generate a modulated pulse signal for controlling the light source based on the reference pulse signal with the pulse width thereof and a control signal;

set a first current required for forming the specific pixel or pixels;

set a second current required for forming the normal pixel or pixels that is/are the pixel or pixels other than the specific pixel or pixels among the plurality of pixels; and generate a supply current based on the first current and the second current.

12. The image forming apparatus according to claim 1, wherein the circuitry is configured to generate a supply current to be supplied to the light source based on the drive signal.

13. The image forming apparatus according to claim 1, wherein the circuitry is configured to selectively determine a phase of the specific pixel or pixels to be a center phase, a left phase, or a right phase.

14. An image forming method for forming an image by scanning an image bearer with light modulated based on image information, the image forming method comprising:

initially adjusting a pulse width of a reference pulse signal;

generating, based on the reference pulse signal serving as a reference to form a plurality of pixels arranged in a main-scanning direction of the image, a drive signal for driving a light source that emits the light;

subsequently adjusting the pulse width of the reference pulse signal so that a first amplitude of a first portion or portions of the reference pulse signal corresponding to a specific pixel or pixels among the plurality of pixels is larger than a second amplitude of a second portion or portions of the reference pulse signal corresponding to a normal pixel or pixels, and so that a first pulse width of the first portion or portions of the reference pulse signal corresponding to the specific pixel or pixels is smaller than a second pulse width of the second portion or portions of the reference pulse signal corresponding to the normal pixel or pixels, the specific pixel or pixels being a part of the plurality of pixels, and the normal pixel or pixels being a pixel or pixels other than the specific pixel or pixels among the plurality of pixels; and generating the drive signal such that an amplitude of the drive signal corresponds to the first amplitude or the second amplitude for each of the plurality of pixels.

15. The image forming method according to claim 14, wherein the specific pixel or pixels is/are a pixel or pixels included in an edge or edges in the main-scanning direction of the image.

16. The image forming method according to claim 14, further comprising:

setting in advance a position or positions of the first portion or portions corresponding to the specific pixel or pixels with respect to the main-scanning direction when the first pulse width of the first portion or portions corresponding to the specific pixel or pixels is reduced to be smaller than the second pulse width of the second portion or portions corresponding to the normal pixel or pixels; and adjusting the pulse width of the reference pulse signal based on the position or positions thus set.

* * * * *